US011660726B2

(12) United States Patent
Haso et al.

(10) Patent No.: US 11,660,726 B2
(45) Date of Patent: May 30, 2023

(54) COATED ABRASIVES HAVING AN IMPROVED SUPERSIZE COATING

(71) Applicants: SAINT-GOBAIN ABRASIVES, INC., Worcester, MA (US); SAINT-GOBAIN ABRASIFS, Conflans-Sainte-Honorine (FR)

(72) Inventors: Fadi Haso, Shrewsbury, MA (US); Anna Maassel, Blacksburg, VA (US); Charles G. Herbert, Shrewsbury, MA (US); William C. Rice, Medway, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 243 days.

(21) Appl. No.: 17/010,940

(22) Filed: Sep. 3, 2020

(65) Prior Publication Data

US 2021/0069866 A1 Mar. 11, 2021

Related U.S. Application Data

(60) Provisional application No. 62/896,148, filed on Sep. 5, 2019.

(51) Int. Cl.
*B24D 3/34* (2006.01)

(52) U.S. Cl.
CPC ..... *B24D 3/342* (2013.01)

(58) Field of Classification Search
CPC ..... B24D 3/342; B24D 3/005; B24D 3/346
See application file for complete search history.

(56) References Cited

U.S. PATENT DOCUMENTS

| | | | |
|---|---|---|---|
| 2,965,589 | A | 12/1960 | Price |
| 3,997,302 | A | 12/1976 | Supkis |
| 4,396,403 | A | 8/1983 | Ibrahim |
| 4,478,731 | A | 10/1984 | Gaucher |
| 4,543,106 | A | 9/1985 | Parekh |
| 4,558,086 | A | 12/1985 | Ramp et al. |
| 4,927,431 | A | 5/1990 | Buchanan et al. |
| 4,973,338 | A | 11/1990 | Gaeta et al. |

(Continued)

FOREIGN PATENT DOCUMENTS

| | | | |
|---|---|---|---|
| CN | 100497817 | C | 6/2009 |
| CN | 102102312 | A | 6/2011 |

(Continued)

OTHER PUBLICATIONS

3M Energy and Advanced Materials Division, "3M Glass Microspheres: Compounding and Injection Molding Guidelines", n.d., 8 pages <https://multimedia.3m.com/mws/media/426234O/3mtm-glass-microspheres-compounding-and-inj-molding-guide.pdf>.

(Continued)

*Primary Examiner* — Pegah Parvini
(74) *Attorney, Agent, or Firm* — Abel Schillinger, LLP; Arpan Ghosh

(57) ABSTRACT

Systems and methods include providing a coated abrasive article with an enhanced anti-loading composition in a supersize coat. The anti-loading composition includes a mixture of a metal stearate, at least one performance component, and a polymeric binder composition.

13 Claims, 10 Drawing Sheets

(56) References Cited

U.S. PATENT DOCUMENTS

| | | | | |
|---|---|---|---|---|
| 4,988,554 | A | 1/1991 | Peterson et al. | |
| 5,164,265 | A | 11/1992 | Stubbs | |
| 5,164,356 | A | 11/1992 | Dalebroux | |
| 5,356,544 | A | 10/1994 | Zilberman et al. | |
| 5,417,726 | A | 5/1995 | Stout et al. | |
| 5,505,747 | A | 4/1996 | Chesley et al. | |
| 5,565,011 | A | 10/1996 | Follett et al. | |
| 5,573,619 | A | 11/1996 | Benedict et al. | |
| 5,578,362 | A | 11/1996 | Reinhardt et al. | |
| 5,667,542 | A | 9/1997 | Law et al. | |
| 5,704,952 | A * | 1/1998 | Law | B24D 3/346 51/306 |
| 5,766,277 | A | 6/1998 | DeVoe et al. | |
| 5,776,290 | A | 7/1998 | Follett et al. | |
| 5,800,677 | A | 9/1998 | Kato | |
| 5,908,477 | A | 6/1999 | Harmer et al. | |
| 5,954,844 | A | 9/1999 | Law et al. | |
| 6,020,413 | A | 2/2000 | Wolff et al. | |
| 6,162,836 | A | 12/2000 | Kato | |
| 6,183,346 | B1 | 2/2001 | Gagliardi | |
| 6,228,133 | B1 * | 5/2001 | Thurber | B24D 11/005 51/297 |
| 6,261,682 | B1 | 7/2001 | Law | |
| 6,664,018 | B2 | 12/2003 | Chen et al. | |
| 6,689,894 | B1 | 2/2004 | Chen | |
| 6,835,220 | B2 | 12/2004 | Swei et al. | |
| 6,951,577 | B2 | 10/2005 | Carter et al. | |
| 7,195,658 | B2 | 3/2007 | Swei et al. | |
| 8,888,878 | B2 | 11/2014 | Wang et al. | |
| 9,284,508 | B2 | 3/2016 | Baran, Jr. et al. | |
| 2001/0011108 | A1 | 8/2001 | Thurber et al. | |
| 2003/0079415 | A1 * | 5/2003 | Carter | B24D 11/001 51/307 |
| 2003/0198886 | A1 | 10/2003 | Chen et al. | |
| 2005/0042187 | A1 | 2/2005 | Verma et al. | |
| 2005/0085167 | A1 | 4/2005 | Swei et al. | |
| 2006/0016128 | A1 | 1/2006 | Oka | |
| 2006/0019579 | A1 | 1/2006 | Braunschweig et al. | |
| 2006/0260208 | A1 | 11/2006 | Swei et al. | |
| 2007/0169420 | A1 | 7/2007 | Swei et al. | |
| 2007/0173180 | A1 | 7/2007 | Swei et al. | |
| 2010/0077673 | A1 | 4/2010 | Oka | |
| 2012/0252321 | A1 * | 10/2012 | Jungbauer | C09K 3/1436 451/28 |
| 2013/0263520 | A1 * | 10/2013 | Houga | B24D 11/001 51/298 |
| 2015/0126098 | A1 * | 5/2015 | Eilers | B24D 11/04 451/529 |
| 2016/0229032 | A1 | 8/2016 | Moren et al. | |
| 2016/0311081 | A1 * | 10/2016 | Culler | B24D 11/001 |
| 2020/0338692 | A1 | 10/2020 | Liu et al. | |

FOREIGN PATENT DOCUMENTS

| | | | |
|---|---|---|---|
| CN | 103266534 | B | 8/2013 |
| CN | 103388284 | A | 11/2013 |
| CN | 103880635 | A | 6/2014 |
| CN | 204017822 | U | 12/2014 |
| CN | 105924344 | A | 9/2016 |
| GB | 598089 | A | 2/1984 |
| JP | S5298760 | A | 8/1977 |
| WO | 199605942 | A1 | 2/1996 |
| WO | 2017117356 | A1 | 7/2017 |
| WO | 2017180205 | A1 | 10/2017 |
| WO | 2017180210 | A1 | 10/2017 |
| WO | 2017180468 | A1 | 10/2017 |

OTHER PUBLICATIONS

The Cary Company, "Q-CEL 7036 Hollow Microspheres", Google Cache date: Nov. 20, 2019, 3 pages.

Potters Industries Inc., Engineered Glass Materials Division, "Q-Cel Hollow Spheres: Lightweight Products", Jul. 2, 2007, 1 page.

Micro Powders, Inc., "MicroTouch—Soft Touch Coating Additives, Formulation Guide", 04/15, 2 pages.

Interpolymer Corporation, "Megatran 220: Patented Polymer Technology from Interpolymer Corporation", Jul. 18, 2005, 10 pages.

Webster, Joseph, "The Perception of Metallic Stearates as Acid Acceptors", Stabilization Technologies LLC, Charlotte, North Carolina, 2006, 53 pages.

Liu Qing-feng,Yan Hai-biao, "The Application of Orthogonal Design in the Synthesis of Zinc Stearate by Hydrothermal Method", School of Chemical and Enviromental Engineering, Hubei University of Technology, Wuhan 430068, China, Nov. 2005, 1 page, Abstract Only.

L. Lazzarotto, et al., "The Effects of Processing Bath Parameters on the Quality and Performance of Zinc Phosphate Stearate Coatings" Surface and Coatings Technology, vol. 122, Issues 2-3, Dec. 15, 1999, pp. 94-100.

"Peter Greven is increasing its capacity by building a new production facility in Malaysia", Apr. 13, 2015, 2 pages.

* cited by examiner

COATED ABRASIVES HAVING AN IMPROVED SUPERSIZE COATING

CROSS-REFERENCE TO RELATED APPLICATION(S)

This application claims priority under 35 U.S.C. § 119(e) to U.S. Provisional Patent Application No. 62/896,148, filed Sep. 5, 2019, by Fadi HASO et al., entitled "COATED ABRASIVES HAVING AN IMPROVED SUPERSIZE COATING," which is assigned to the current assignee hereof and incorporated herein by reference in its entirety for all purposes.

FIELD OF THE INVENTION

The present invention relates generally to coated abrasive articles that include an enhanced and improved anti-loading composition, as well as methods of making and using the coated abrasive articles.

BACKGROUND

Abrasive articles, such as coated abrasives, are used in various industries to abrade work pieces, such as by sanding, lapping, grinding, and polishing. Surface processing using abrasive articles spans a wide scope from initial coarse material removal to high precision finishing and polishing of surfaces at a submicron level. Effective and efficient abrasion of surfaces poses numerous processing challenges.

Typically, users seek to achieve cost effective abrasive materials and processes that achieve high material removal rates. However, abrasives and abrasive processes that exhibit high removal rates often tend to exhibit poor performance, if not impossibility, in achieving certain desired surface characteristics. Conversely, abrasives that produce such desirable surface characteristics can often have low material removal rates, which can require more time and effort to remove a sufficient amount of surface material.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION

Figure 1:
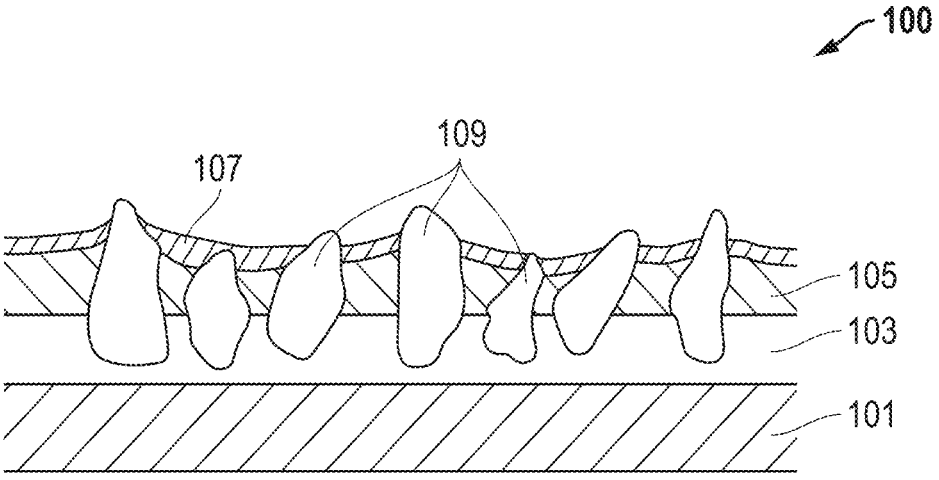
FIG. 1 is a cross sectional side view of an embodiment of a coated abrasive article according to an embodiment of the disclosure.

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variations thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as D50.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the coated abrasive arts.

FIG. 1 is a cross sectional side view of a coated abrasive article 100 according to an embodiment of the disclosure. The coated abrasive article 100 may generally comprise a substrate (also referred to herein as a "backing material" or "backing") 101 on which an abrasive layer may be disposed. The abrasive layer may include abrasive grains or particles 109 disposed at least partially on or in a polymeric make coat binder layer ("make coat") 103 that is disposed on the backing material 101. In some embodiments, the make coat 103 may include the abrasive particles 109. In some embodiments, the abrasive layer may also comprise a size coat layer 105 ("size coat") disposed on the abrasive layer (i.e., over the make coat binder layer 103 and the abrasive particles). Additionally, in some embodiments, an anti-loading supersize coat layer 107 ("supersize coat") may be disposed over the size coat layer 105. The anti-loading supersize coat layer 107 comprises an enhanced anti-loading composition. In an embodiment, the enhanced anti-loading composition may comprise the product of a mixture of a metal stearate, at least one performance component, and a polymeric binder composition. Further, in alternative embodiments, it will be appreciated that the enhanced anti-loading composition could be disposed directly on the abrasive layer as the size coat 105.

Figure 2:
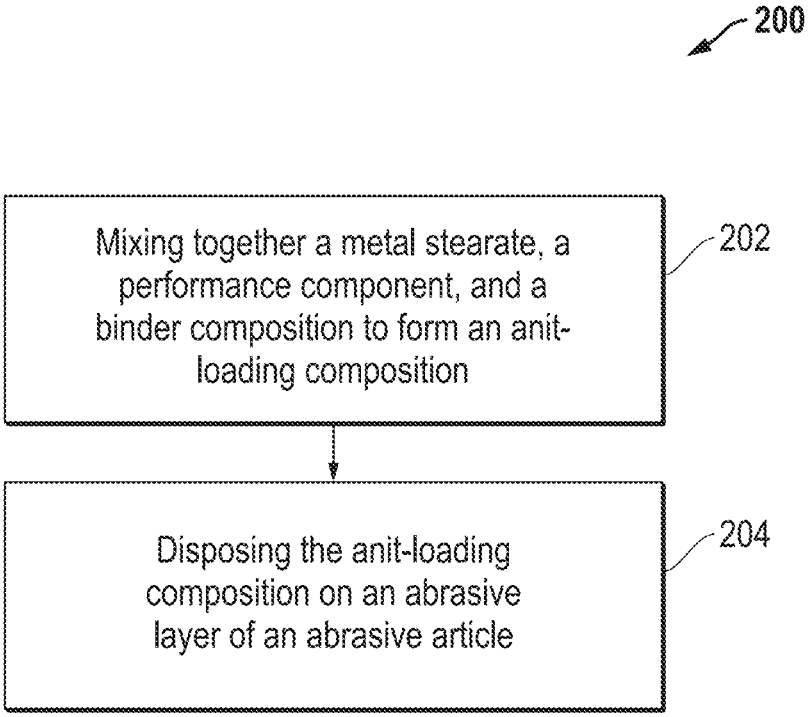
FIG. 2 is a flowchart of a method of making a coated abrasive article that includes an enhanced anti-loading supersize coat according to an embodiment of the disclosure.

FIG. 2 is a flowchart of a method 200 of forming a coated abrasive article 100 that includes an anti-loading enhanced supersize coat 107 according to an embodiment of the disclosure. Step 202 includes mixing together a metal stearate, at least one performance component, and optionally, a binder composition to form an enhanced anti-loading composition. In some embodiments, step 202 may also comprise mixing a wax, a wax component, and/or a protein with at least one of the metal sulfide, the plurality of microspheres, and the optional binder composition to form the enhanced anti-loading composition. Step 204 includes disposing the enhanced anti-loading composition on an abrasive layer or on a size coat layer 105 of an abrasive article to form a coated abrasive article 100 having an enhanced anti-loading composition.

Figure 3:
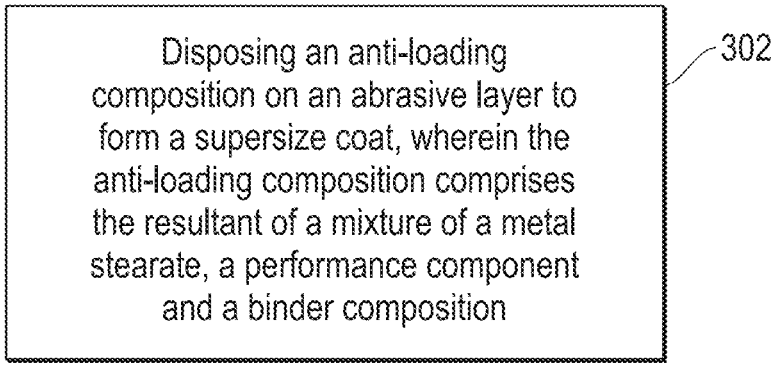
FIG. 3 is a flowchart of a method of making a coated abrasive article that includes an improved anti-loading supersize layer according to another embodiment of the disclosure.

FIG. 3 is an illustration of a flowchart of a method 300 of making a coated abrasive article 100 that includes an anti-loading enhanced supersize coat 107 according to another embodiment of the disclosure. Step 302 includes disposing an anti-loading composition on an abrasive layer of a coated abrasive article 100, wherein the anti-loading composition comprises the resultant of a mixture of a metal stearate, at least one performance component, (e.g., metal sulfide, such as copper iron sulfide, a plurality of microcomponents, a wax or wax component, and/or a protein), and a polymeric binder composition.

Anti-Loading Composition

It has been discovered that an anti-loading composition comprising the resultant of a mixture (also called herein "the product of" a mixture) comprising a metal stearate, at least one performance component (e.g., metal sulfide, such as copper iron sulfide, a plurality of microcomponents, a wax or wax component, and/or a protein), and optionally, a binder composition provides unexpected and beneficial anti-loading and abrasive performance to a coated abrasive article. In some embodiments, the anti-loading composition may be applied as the supersize coat 107 of a coated abrasive article 100. Further, it has also been discovered that the presence of one or more of certain performance components (e.g., a wax, a wax component, and/or a protein) provides unexpected and beneficial visual properties, such as translucency and/or transparency, to the anti-loading composition as well as controlling or eliminating the appearance of opaque streaking in the anti-loading composition.

Metal Stearate

The anti-loading composition may comprise a metal soap, such as a metal stearate, metal stearate dispersion, a hydrate form thereof, or a combination thereof. In an embodiment, the metal stearate may comprise zinc stearate, calcium stearate, lithium stearate, hydrate forms thereof, or a combination thereof. Accordingly, in one specific embodiment, the metal stearate may comprise calcium stearate. However, in another specific embodiment, the metal stearate may comprise zinc stearate. In another specific embodiment, the metal stearate may comprise a zinc stearate dispersion. In other embodiments, the metal stearate may comprise a combination of calcium stearate and zinc stearate.

The amount of metal stearate in the anti-loading composition can vary. In some embodiments, the amount of metal stearate in the anti-loading composition may not be less than 10 wt. %, such as not less than 15 wt. %, not less than 20 wt. %, not less than 25 wt. %, not less than 30 wt. %, not less than 35 wt. %, not less than 40 wt. %, not less than 45 wt. %, not less than 50 wt. %, not less than 55 wt. %, not less than 60 wt. %, not less than 65 wt. %, or not less than 70 wt. %. In other embodiments, the amount of metal stearate in the anti-loading composition may not be greater than 99 wt. %, such as not greater than 95 wt. %, not greater than 90 wt. %, not greater than 85 wt. %, or not greater than 80 wt. %. The amount of the metal stearate may also be within a range comprising any pair of the previous upper and lower limits. In a particular embodiment, the amount of the metal stearate may be in the range of not less than 10 wt. % to not greater than 99 wt. %.

Performance Component

The anti-loading composition may comprise the resultant of a mixture including one or more performance components. It will be recognized that sometimes the performance component will be a starting ingredient of the mixture that might partially to fully react with other ingredients of the mixture such that the performance component is no longer present as a separate chemical moiety in the resultant mixture (i.e., after the ingredients have been combined together). On the other hand, sometimes the performance component will still be present as a separate chemical moiety in the resultant mixture after the ingredients have been combined. Thus, the phrase "resultant of the mixture of" indicates that the performance component is detectable as a starting ingredient of the mixture. Alternatively, the performance component may be described as being a detectable moiety of the resultant mixture.

In an embodiment, the performance component may comprise a metal sulfide, a wax, a wax component, a fatty acid, a protein, a microcomponent, a plurality of microcomponents, or a combination thereof. In a specific embodiment, the performance component comprises a metal salt. In another specific embodiment, the performance component comprises a metal oxide. In another specific embodiment, the performance component comprises a metal hydroxide. In another specific embodiment, the performance component comprises a metal salt and a fatty acid. In another specific embodiment, the performance component comprises a wax, a wax component, or a combination thereof. In another specific embodiment, the performance component comprises a metal sulfide. In another specific embodiment, the performance component comprises a protein. In another specific embodiment, the performance component comprises a microcomponent or a plurality of microcomponents.

The amount of performance component can vary. In an embodiment, the amount of performance component may be not less than 0.1 wt. %, such as not less than 0.5 wt. %, not less than 1 wt. %, not less than 2 wt. %, not less than 3 wt. %, not less than 5 wt. %, not less than 7 wt. %, not less than 9 wt. %, not less than 10 wt. %, not less than 12 wt. %, not less than 15 wt. %, or not less than 20 wt. %. In another embodiment, the amount of performance component may be not greater than 95 wt. %, such as not greater than 90 wt. %, not greater than 85 wt. %, not greater than 80 wt. %, not greater than 75 wt. %, not greater than 70 wt. %, not greater than 65 wt. %, not greater than 60 wt. %, not greater than 55 wt. %, not greater than 50 wt. %, not greater than 45 wt. %, not greater than 40 wt. %, not greater than 30 wt. %, not greater than 25 wt. %, or not greater than 20 wt. %. The amount of the performance component may be within a range comprising any pair of the previous upper and lower limits. In a particular embodiment, the amount of the performance component may be in the range of not less than 0.1 wt. % to not greater than 95 wt. %, such as not less than 0.1 wt. % to not greater than 90 wt. %, not less than 0.1 wt. % to not greater than 85 wt. %, not less than 0.1 wt. % to not greater than 80 wt. %, not less than 0.1 wt. % to not greater than 75 wt. %, not less than 0.1 wt. % to not greater than 70 wt. %, not less than 0.1 wt. % to not greater than 65 wt. %, not less than 0.1 wt. % to not greater than 60 wt. %, not less than 0.1 wt. % to not greater than 55 wt. %, not less than 0.1 wt. % to not greater than 50 wt. %, not less than 0.1 wt. % to not greater than 45 wt. %, not less than 0.1 wt. % to not greater than 40 wt. %, such as not less than 0.5 wt. % to not greater than 35 wt. %, or not less than 1 wt. % to not greater than 25 wt. %.

Metal Sulfide

In an embodiment, the metal sulfide may comprise an iron sulfide, a copper sulfide, a copper iron sulfide, or any combination thereof. In an embodiment, the iron sulfide may comprise pyrite. In an embodiment, the copper sulfide may comprise chalcocite. In an embodiment, the copper iron sulfide may comprise chalcopyrite.

The amount of metal sulfide can vary. In an embodiment, the amount of metal sulfide may be not less than 0.1 wt. %, such as not less than 0.5 wt. %, not less than 1 wt. %, not less than 2 wt. %, not less than 3 wt. %, not less than 5 wt. %, not less than 7 wt. %, or not less than 10 wt. %. In another embodiment, the amount of metal sulfide may be not greater than 35 wt. %, such as not greater than 30 wt. %, not greater than 25 wt. %, not greater than 22 wt. %, not greater than 20 wt. %, not greater than 18 wt. %, not greater than 16 wt. %, not greater than 14 wt. %, or not greater than 12 wt. %. The amount of the metal sulfide may be within a range comprising any pair of the previous upper and lower limits. In a particular embodiment, the amount of the metal sulfide may be in the range of not less than 10 wt. % to not greater than 35 wt. %.

Wax

In some embodiments, the anti-loading composition may comprise a wax and/or a wax component that modifies the pattern of the coated abrasive article 100. In some embodiments, the wax may comprise a natural wax, a synthetic wax, or any combination thereof. In some embodiments, the wax may comprise a petroleum-based wax such as a polyolefin wax. In some embodiments, the wax lubricant may comprise a vegetable wax, such as carnauba wax, that comprises at least some stearate ester functionality to serve as a friction modifier by adsorbing onto a workpiece during grinding.

The amount of wax can vary. In an embodiment, the amount of wax may be not less than 0.1 wt. %, such as not less than 0.5 wt. %, not less than 1 wt. %, not less than 2 wt. %, not less than 3 wt. %, not less than 5 wt. %, not less than 7 wt. %, not less than 10 wt. %, or not less than 12 wt. %. In another embodiment, the amount of wax may be not greater than 95 wt. %, such as not greater than 90 wt. %, not greater than 88 wt. %, not greater than 85 wt. %, not greater than 80 wt. %, not greater than 75 wt. %, not greater than 70 wt. %, not greater than 65 wt. %, not greater than 60 wt. %, not greater than 55 wt. %, not greater than 50 wt. %, not greater than 45 wt. %, not greater than 40 wt. %, not greater than 35 wt. %, not greater than 30 wt. %, not greater than 25 wt. %, or not greater than 20 wt. %. The amount of the wax may be within a range comprising any pair of the previous upper and lower limits. In a particular embodiment, the amount of wax may be in the range of not less than 1 wt. % to not greater than 95 wt. %, such as not less than 5 wt. % to not greater than 55 wt. %, not less than 7 wt. % to not greater than 40 wt. %, or not less than 10 wt. % to not greater than 25 wt. %.

Fatty Acid

In an embodiment, the fatty acid may comprise an unsaturated fatty acid or a saturated fatty acid having from 14 to 22 carbon atoms or a combination thereof, such as myristic acid ($CH_3(CH_2)_{12}COOH$), palmitic acid ($CH_3(CH_2)_{14}COOH$), stearic acid (($CH_3(CH_2)_{16}COOH$), arachidic acid ($CH_3(CH_2)_{18}COOH$), behenic acid ($CH_3(CH_2)_{20}COOH$), or a combination thereof. In a specific embodiment, the fatty acid is stearic acid.

The amount of fatty acid can vary. In an embodiment, the amount of saturated fatty acid may be not less than 0.1 wt. %, such as not less than 0.3 wt. %, not less than 0.5 wt. %, not less than 0.7 wt. %, not less than 1 wt. %, not less than 1.3 wt. %, or not less than 1.5 wt. %. In another embodiment, the amount of fatty acid may be not greater than 30 wt. %, such as not greater than 25 wt. %, not greater than 20 wt. %, not greater than 15 wt. %, not greater than 10 wt. %, not greater than 7.5 wt. %, or not greater than 5 wt. %. The amount of the fatty acid may be within a range comprising any pair of the previous upper and lower limits. In a particular embodiment, the amount of the fatty acid may be in the range of not less than 0.1 wt. % to not greater than 30 wt. %, such as not less than 0.5 wt. % to not greater than 25 wt. %, not less than 1 wt. % to not greater than 20 wt. %, or not less than 1.5 wt. % to not greater than 15 wt. %.

Protein

In some embodiments, the anti-loading composition may comprise a protein that modifies the pattern of the coated abrasive article 100. In an embodiment, the protein may comprise a globular protein or a plurality of globular proteins used to adjust appearance of the coated abrasive article 100. In a specific embodiment, the globular protein may be whey protein. In such embodiments, the whey protein may be a concentrate, an isolate, a hydrolysate, or a combination thereof.

The amount of protein can vary. In an embodiment, the amount of protein may be not less than 0.1 wt. %, such as not less than 0.3 wt. %, not less than 0.5 wt. %, not less than 0.7 wt. %, not less than 1 wt. %, not less than 1.3 wt. %, or not less than 1.5 wt. %. In another embodiment, the amount of protein may be not greater than 30 wt. %, such as not greater than 25 wt. %, not greater than 20 wt. %, not greater than 15 wt. %, not greater than 10 wt. %, not greater than 7.5 wt. %, or not greater than 5 wt. %. The amount of the protein may be within a range comprising any pair of the previous upper and lower limits. In a particular embodiment, the amount of the protein may be in the range of not less than 0.1 wt. % to not greater than 30 wt. %, such as not less than 0.5 wt. % to not greater than 25 wt. %, not less than 1 wt. % to not greater than 20 wt. %, or not less than 1.5 wt. % to not greater than 5 wt. %.

Microcomponent

In some embodiments, the microcomponent may comprise a microsphere or plurality of microspheres. In some embodiments, the microspheres may comprise a single type of microsphere or a plurality of types of microsphere. In some embodiments, the microspheres may be amorphous, porous, or a combination thereof. In some embodiments, the microspheres may comprise a ceramic microsphere, a polymeric microsphere, a glass microsphere, or a combination thereof. In some embodiments, a ceramic microsphere may comprise a silica gel, a silica alumina gel, or a combination thereof. In a specific embodiment, the ceramic microsphere(s) may comprise an amorphous, porous silica alumina gel. In some embodiments, a polymeric microsphere may comprise polyurethane, polystyrene, a polyethylene, a rubber, a poly(methyl methacrylate) (PMMA), a glycidyl methacrylate, an epoxy, or a combination thereof. In a specific embodiment, the polyurethane microsphere(s) may comprise aliphatic polyurethane.

In an embodiment, the microcomponent may be of a particular particle size. In an embodiment, the microcomponent may comprise a particle size, or alternatively an average particle size, that is not greater than 1000 microns, such as not greater than about 500 microns, not greater than about 250 microns, not greater than about 200 microns, or not greater than 150 microns. In other embodiments, a microcomponent may comprise a particle size, or alternatively an average particle size, that is not greater than about 150 microns, such as not greater than about 125 microns, not greater than about 100 microns, not greater than about 50 microns, not greater than about 35 microns, not greater than about 25 microns, not greater than about 20 microns, or not greater than about 15 microns.

In another embodiment, the microcomponent may comprise a particle size, or alternatively an average particle size, that is at least about 0.1 microns, at least about 1 micron, at least about 2 microns, at least about 3 microns, at least 4 about microns, at least about 5 microns, or at least about 10 microns. In a specific embodiment, a ceramic microcomponent particle size may be from at least about 0.1 microns to at least about 150 microns. In a specific embodiment, a polymeric microcomponent particle size may be from at least about 0.1 microns to at least about 120 microns. However, it will be appreciated that the particle size, or average particle size, of the microcomponent may be between any of these minimum and maximum values. The size of the microcomponent is typically specified to be the longest dimension of the microcomponent. Generally, there is a range distribution of particle sizes. In some instances, the particle size distribution is tightly controlled.

The amount of microcomponent can vary. In an embodiment, the amount of microcomponent may be not less than 0.1 wt. %, such as not less than 0.3 wt. %, not less than 0.5 wt. %, not less than 0.7 wt. %, not less than 1 wt. %, not less than 1.3 wt. %, not less than 1.5 wt. %, not less than 2 wt. %, not less than 3 wt. %, not less than 4 wt. %, or not less than 5 wt. %. In another embodiment, the amount of microcomponent may be not greater than 20 wt. %, such as not greater than 15 wt. %, not greater than 10 wt. %, not greater than 7 wt. %, not greater than 6 wt. %, not greater than 5 wt. %, not greater than 4 wt. %, or not greater than 3 wt. %. The amount of the microcomponent may also be within a range comprising any pair of the previous upper and lower limits. In a particular embodiment, the amount of the microcomponent may be in the range of not less than 0.1 wt. % to not greater than 20 wt. %, such as not less than 0.5 wt. % to not greater than 15 wt. %, not less than 1 wt. % to not greater than 10 wt. %, or not less than 2 wt. % to not greater than 10 wt. %.

Binder Composition

The anti-loading composition may comprise a binder composition. The binder composition may be non-polymeric composition, a polymeric composition, or a combination thereof. In an embodiment, the binder composition may comprise a polymeric binder composition. The polymeric binder composition may be formed of a single polymer or a blend of polymers by the reaction of small molecules to form a polymer or blend of polymers, drying a single polymer, drying a blend of polymers, or a combination thereof. The binder composition may be formed from an epoxy composition, an acrylic composition, a phenolic composition, a polyurethane composition, a urea formaldehyde composition, a polysiloxane composition, or a combination thereof. In a specific embodiment, the binder composition comprises a polymeric acrylic composition. The acrylic composition may comprise an aqueous emulsion. The acrylic composition may comprise an acrylic co-polymer, such as a carboxylated acrylic copolymer. The acrylic composition may comprise a glass transition temperature (Tg) in a beneficial temperature range, such as from 35° C. to 100° C.

The amount of polymeric binder composition in the anti-loading composition can vary. In an embodiment, the amount of polymeric binder composition may be not less than 0.1 wt. %, such as not less than 0.3 wt. %, not less than 0.5 wt. %, not less than 1 wt. %, not less than 2 wt. %, not less than 3 wt. %, not less than 4 wt. %, not less than 5 wt. %, or not less than 6 wt. %. In another embodiment, the amount of polymeric binder composition in the supersize coat may be not greater than 25 wt. %, such as not greater than 23 wt. %, not greater than 20 wt. %, not greater than 18 wt. %, not greater than 15 wt. %, not greater than 13 wt. %, not greater than 12 wt. %, not greater than 11 wt. %, not greater than 10 wt. %, not greater than 9 wt. %, or not greater than 8 wt. %. The amount of weight of the polymeric binder composition may be within a range comprising any pair of the previous upper and lower limits. In a particular embodiment, the amount of weight of the polymeric binder composition may be in the range of not less than 0.1 wt. % to not greater than 25 wt. %, such as not less than 0.5 wt. % to not greater than 20 wt. % GSM, not less than 1 wt. % to not greater than 15 wt. %.

Substrate ("Backing Material")

The substrate (also referred to herein as a "backing material" or "backing") 101 may be flexible or rigid. The backing material 101 may be made of any number of various materials including those conventionally used as backings in the manufacture of coated abrasives. An exemplary flexible backing material 101 includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton, rayon, or combinations thereof); paper; vulcanized paper; vulcanized rubber; vulcanized fiber; nonwoven materials; a combination thereof; or a treated version thereof. Cloth backings may be woven or stitch bonded. In particular examples, the backing material 101 is selected from the group consisting of paper, polymer film, cloth (e.g., cotton, poly-cotton, rayon, polyester, polynylon), vulcanized rubber, vulcanized fiber, metal foil and a combination thereof. In other examples, the backing material 101 includes polypropylene film or polyethylene terephthalate (PET) film.

The backing material 101 may optionally have at least one of a saturant, a presize layer (also called a "front fill layer"), or a backsize layer (also called a "back fill layer"). The purpose of these layers is typically to seal the backing material 101 or to protect yarn or fibers in the backing. If the backing material 101 is a cloth material, at least one of these layers is typically used. The addition of the presize layer or backsize layer may additionally result in a "smoother" surface on either the front or the back side of the backing material 101. Other optional layers known in the art may also be used such as a tie layer.

In some embodiments, the backing material 101 may be a fibrous reinforced thermoplastic such as described, for example, in U.S. Pat. No. 5,417,726 (Stout et al.), or an endless spliceless belt, as described, for example, in U.S. Pat. No. 5,573,619 (Benedict et al.). Likewise, the backing material 101 may be a polymeric substrate having hooking stems projecting therefrom such as that described, for example, in U.S. Pat. No. 5,505,747 (Chesley et al.). Similarly, the backing material 101 may be a loop fabric such as that described, for example, in U.S. Pat. No. 5,565,011 (Follett et al.).

Abrasive Layer

The abrasive layer comprises a plurality of abrasive particles 109 disposed on, or dispersed in, a polymeric make coat binder layer 103.

Abrasive Particles

Abrasive particles 109 may include essentially single phase inorganic materials, such as alumina, silicon carbide, silica, ceria, and harder, high performance superabrasive particles such as cubic boron nitride and diamond. Additionally, the abrasive particles 109 may include composite particulate materials. Such materials may include aggregates, which can be formed through slurry processing pathways that include removal of the liquid carrier through volatilization or evaporation, leaving behind unfired ("green") aggregates, that can optionally undergo high temperature treatment (i.e., firing, sintering) to form usable, fired aggregates. Further, the abrasive particles 109 may include engineered abrasives including macrostructures and particular three-dimensional structures.

In an embodiment, the abrasive particles 109 are blended with a binder composition to form an abrasive slurry. Alternatively, the abrasive particles 109 are applied over the binder composition after the binder composition is applied to the backing material 101. Optionally, a functional powder may be applied over abrasive regions to prevent the abrasive regions from sticking to a patterning tooling. Alternatively, patterns may be formed in the abrasive regions absent the functional powder.

The abrasive particles 109 may be formed of any one of or a combination of abrasive particles 109, including silica, alumina (fused, sintered, seeded gel), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive particles 109 may be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive particles 109 comprised principally of alpha-alumina.

The abrasive particles 109 may also have a particular shape. Examples of such shapes include, but are not limited to, a rod, a triangle, a pyramid, a cone, a solid sphere, a hollow sphere, or the like. Alternatively, the abrasive particles 109 may be randomly shaped.

In an embodiment, the abrasive particles 109 may comprise an average particle size that is not greater than 2000 microns, such as not greater than about 1500 microns, not greater than about 1000 microns, not greater than about 750 microns, or not greater than 500 microns. In another embodiment, the abrasive particles 109 may comprise an average particle size that is at least 0.1 microns, at least 1 micron, at least 5 microns, at least 10 microns, at least 25 microns, or at least 45 microns. In another embodiment, the abrasive particles 109 may comprise an average particle size that is from about 0.1 microns to about 2000 microns. The particle size of the abrasive particles 109 is typically specified to be the longest dimension of the abrasive particle 109. Generally, there is a range distribution of particle sizes. In some instances, the particle size distribution is tightly controlled.

Make Coat Layer—Make Coat Composition

The coated abrasive article 100 may comprise a polymeric make coat binder layer ("make coat") 103 disposed on the backing material 101. The make coat 103 generally comprises a make coat composition in which a plurality of abrasive particles 109 are at least partially disposed in or on. The make coat composition (commonly known as the "make coat") may be formed of a single polymer or a blend of polymers by the reaction of small molecules to form a polymer or blend of polymers, drying a single polymer, drying a blend of polymers, or a combination thereof. The make coat composition may be formed from an epoxy composition, acrylic composition, a phenolic composition, a polyurethane composition, a phenolic composition, a polysiloxane composition, or combinations thereof. The make coat composition generally includes a polymer matrix, which binds abrasive particles to the backing or to a compliant coat, if such a compliant coat is present. Typically, the make coat composition is formed of cured formulation.

In an embodiment, the make coat composition includes a polymer component and a dispersed phase. The make coat composition may include one or more reaction constituents or polymer constituents for the preparation of a polymer. A polymer constituent may include a monomeric molecule, a polymeric molecule, or a combination thereof. The make coat composition may further comprise components selected from the group consisting of solvents, plasticizers, chain transfer agents, catalysts, stabilizers, dispersants, curing agents, reaction mediators and agents for influencing the fluidity of the dispersion.

The polymer constituents may form thermoplastics or thermosets. By way of example, the polymer constituents may include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent that cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The make coat composition may include a monomer, an oligomer, a polymer, or a combination thereof. In a particular embodiment, the make coat composition includes monomers of at least two types of polymers that when cured may crosslink. For example, the make coat composition may include epoxy constituents and acrylic constituents that when cured form an epoxy/acrylic polymer.

Size Coat—Size Coat Composition

The coated abrasive article 100 may comprise a polymeric size coat binder layer ("size coat") 105 disposed on the abrasive layer. The size coat 105 generally comprises a size coat composition. The size coat composition may be the same as or different from the make coat composition used to form the make coat 103 of the abrasive layer. The size coat 105 may comprise any conventional compositions known in the art that may be used as a size coat. In some embodiments, the size coat 105 may also include one or more additives.

Additives

The make coat 103, size coat 105, or supersize coat 107 may include one or more additives. Suitable additives may include grinding aids, fibers, lubricants, wetting agents, thixotropic materials, surfactants, thickening agents, pigments (including metallic pigments, metal powder pigments, and pearl pigments), dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials may be selected to provide the properties desired. These optional additives may be present in any part of the overall system of the coated abrasive product according to embodiments of the present disclosure. Suitable grinding aids may be inorganic based; such as halide salts, for example cryolite, wollastonite, and potassium fluoroborate; or organic based, such as sodium lauryl sulphate, or chlorinated waxes, such as polyvinyl chloride. In an embodiment, the grinding aid may be an environmentally sustainable material.

EXAMPLES

Example 1: Anti-Loading Composition Preparation—Copper Iron Sulfide

Anti-loading compositions (uncured) ("S16") was prepared by thoroughly mixing together: a metal stearate (zinc stearate dispersion, 48 wt. % total solids, 44% wt. % zinc stearate), a metal sulfide (copper iron sulfide), a polymeric binder (acrylic polymer emulsion), and a defoamer. S16 included 35 wt. % of copper iron sulfide The resultant uncured anti-loading compositions were then ready to be applied as a supersize coat to coated abrasive articles. The anti-loading compositions are shown in the table below.

TABLE 1

Anti-Loading Composition - Copper Iron Sulfide

| | S16 Wt. % (uncured) | S16 Wt. % (cured) |
|---|---|---|
| Metal Stearate[1] (Zinc Stearate) | 54.8 | 40.2 |
| Defoamer | 0.3 | 0.5 |
| Copper Iron Sulfide | 35 | 52.5 |
| Polymeric Binder[2] | 10 | 6.9 |

[1]Zinc stearate dispersion (48 wt. % total solids; 44 wt. % zinc stearate)
[2]Acrylic latex emulsion (45 wt. % solids)

Figure 4:
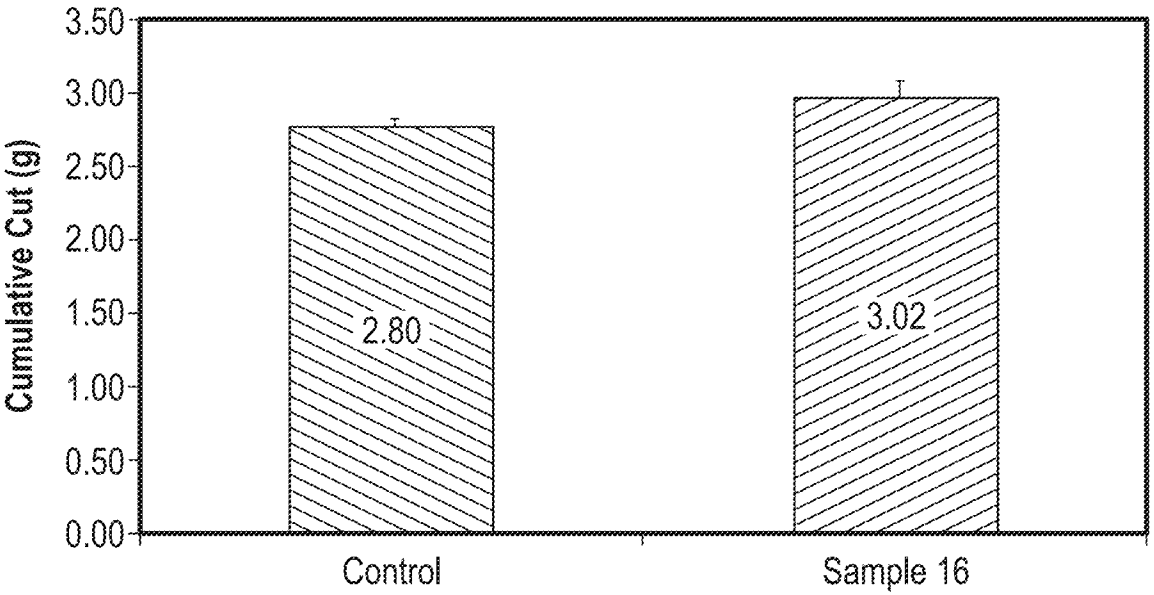
FIG. 4 is a graph showing cumulative material removal performance of a conventional coated abrasive article compared to coated abrasive article embodiments that include an anti-loading composition having a metal sulfide performance component.

The anti-loading composition S16 was applied as a supersize layer onto the size coat of coated abrasive discs. The anti-loading composition was cured to form sample abrasive discs (Sample 16). The sample abrasive discs were then subjected to abrasive testing compared to control abrasive discs. The only difference between the sample discs and the control discs was the presence of the performance component in the anti-loading composition comprising the supersize layer of the sample discs. In other words, the control discs were coated with a conventional zinc stearate composition as a supersize layer that did not contain performance components. The samples were prepared by coating a supersize layer with a 2-roll coater onto a flat stock coated abrasive over the size layer and dried. The resulting coated abrasive articles were then converted to hook and loop backed 6" discs. The discs were tested using a robotic controlled dual action (DA) sander on acrylic panels for 12 minutes. The amount of material removed from the work piece (Total Cut) was recorded and compared to the performance of the control disc. The testing results are shown in the table below and in FIG. 4.

TABLE 2

Abrasive Performance Compared to Control

| | Total Cut (g) | % of Control |
|---|---|---|
| Control | 2.80 | 100 |
| Sample 16 | 3.02 | 108 |

Surprisingly and beneficially, all the sample discs achieved greater performance than the control.

Example 2: Anti-Loading Composition Preparation—Copper Iron Sulfide

Anti-loading compositions (uncured) ("S17", "S18", and "S19") were prepared by thoroughly mixing together: a metal stearate (zinc stearate dispersion, 48 wt. % total solids, 44% wt. % zinc stearate), a metal sulfide (copper iron sulfide), a polymeric binder (acrylic polymer emulsion), and a defoamer. The resultant uncured anti-loading compositions were then ready to be applied as a supersize coat to coated abrasive articles. The anti-loading compositions are shown in the table below.

TABLE 3

| Anti-Loading Composition - Copper Iron Sulfide | | | | | | |
|---|---|---|---|---|---|---|
| | S17 Wt. % (uncured) | S17 Wt. % (cured) | S18 Wt. % (uncured) | S18 Wt. % (cured) | S19 Wt. % (uncured) | S19 Wt. % (cured) |
| Metal Stearate[1] (Zinc Stearate) | 79.8 | 72.5 | 69.8 | 57.9 | 54.8 | 40.2 |
| Defoamer | 0.3 | 0.5 | 0.3 | 0.4 | 0.3 | 0.4 |
| Copper Iron Sulfide | 10 | 18.5 | 20 | 33.9 | 35 | 52.5 |
| Polymeric Binder[2] | 10 | 8.5 | 10 | 7.8 | 10 | 6.9 |

[1]Zinc stearate dispersion (48 wt. % total solids; 44 wt. % zinc stearate)
[2]Acrylic latex emulsion (45 wt. % solids)

Figure 5:
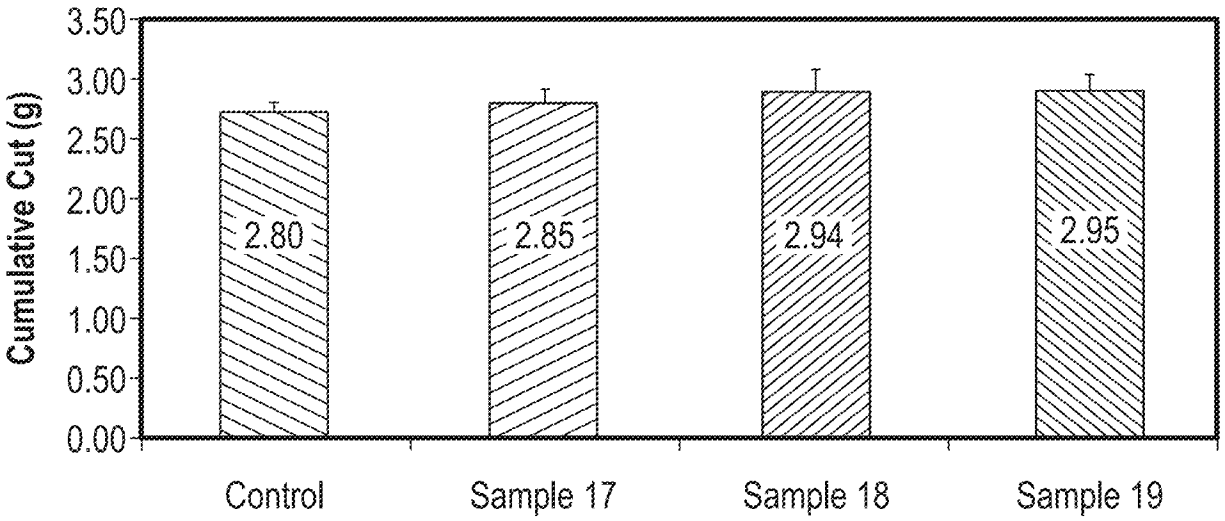
FIG. 5 is a graph showing cumulative material removal performance of a conventional coated abrasive article compared to coated abrasive article embodiments that include an anti-loading composition having a metal sulfide performance component.

The anti-loading compositions S17, S18, and S19 were applied as a supersize layer onto the size coat of coated abrasive discs. The anti-loading compositions were cured to form sample abrasive discs (Sample 17, Sample 18, and Sample 19). The sample abrasive discs were then subjected to abrasive testing compared to control abrasive discs. The only difference between the sample discs and the control discs was the presence of the performance component in the anti-loading composition comprising the supersize layer of the sample discs. In other words, the control discs were coated with a conventional zinc stearate composition as a supersize layer that did not contain performance components. The samples were prepared by coating a supersize layer with a 2-roll coater onto a flat stock coated abrasive over the size layer and dried. The resulting coated abrasive articles were then converted to hook and loop backed 6" discs. The discs were tested using a robotic controlled dual action (DA) sander on acrylic panels for 12 minutes. The amount of material removed from the work piece (Total Cut) was recorded and compared to the performance of the control disc. The testing results are shown in the table below and in FIG. 5.

TABLE 4

| Abrasive Performance Compared to Control | | |
|---|---|---|
| | Total Cut (g) | % of Control |
| Control | 2.80 | 100 |
| Sample 17 | 2.85 | 102 |
| Sample 18 | 2.94 | 105 |
| Sample 19 | 2.95 | 105 |

Surprisingly and beneficially, all the sample discs achieved greater performance than the control.

Example 3: Anti-Loading Composition Preparation—Ceramic Microspheres

Anti-loading compositions (uncured) ("S22" to "S28") were prepared by thoroughly mixing together: a metal stearate (zinc stearate dispersion, 48 wt. % total solids, 44% wt. % zinc stearate), ceramic microspheres (silica alumina gel microspheres), a polymeric binder (acrylic polymer emulsion), and a defoamer. The resultant uncured anti-loading compositions were then ready to be applied as a supersize coat to coated abrasive articles. The anti-loading compositions are shown in the tables below.

TABLE 5

| Anti-Loading Composition - Ceramic Microspheres (150 micron) | | | | | | |
|---|---|---|---|---|---|---|
| | S20 Wt. % (uncured) | S20 Wt. % (cured) | S21 Wt. % (uncured) | S21 Wt. % (cured) | S22 Wt. % (uncured) | S22 Wt. % (cured) |
| Metal Stearate[1] (Zinc Stearate) | 88.89 | 88.3 | 88.02 | 86.5 | 87.17 | 84.8 |
| Defoamer | 0.25 | 0.5 | 0.25 | 0.5 | 0.24 | 0.5 |
| Ceramic Microspheres[3] (30-150 micron) | 0.99 | 2.0 | 1.96 | 4.0 | 2.91 | 5.8 |
| Polymeric Binder[2] | 9.87 | 9.2 | 9.77 | 9.0 | 9.68 | 8.8 |

[1]Zinc stearate dispersion (48 wt. % total solids; 44 wt. % zinc stearate )
[2]Acrylic latex emulsion (45 wt. % solids)
[3]Zeeospheres, silica alumina gel microspheres, 30-150 micron

TABLE 6

| Anti-Loading Composition - Ceramic Microspheres (14 micron) | | | | | | |
|---|---|---|---|---|---|---|
| | S23 Wt. % (uncured) | S23 Wt. % (cured) | S24 Wt. % (uncured) | S24 Wt. % (cured) | S25 Wt. % (uncured) | S25 Wt. % (cured) |
| Metal Stearate[1] (Zinc Stearate) | 88.89 | 88.3 | 88.02 | 86.5 | 87.17 | 84.8 |

TABLE 6-continued

| Anti-Loading Composition - Ceramic Microspheres (14 micron) | | | | | | |
|---|---|---|---|---|---|---|
| | S23 Wt. % (uncured) | S23 Wt. % (cured) | S24 Wt. % (uncured) | S24 Wt. % (cured) | S25 Wt. % (uncured) | S25 Wt. % (cured) |
| Defoamer | 0.25 | 0.5 | 0.25 | 0.5 | 0.24 | 0.5 |
| Ceramic Microspheres[3] (5-14 micron) | 0.99 | 2.0 | 1.96 | 4.0 | 2.91 | 5.8 |
| Polymeric Binder[2] | 9.87 | 9.2 | 9.77 | 9.0 | 9.68 | 8.8 |

[1]Zinc stearate dispersion (48 wt. % total solids; 44 wt. % zinc stearate )
[2]Acrylic latex emulsion (45 wt. % solids)
[3]Zeeospheres, silica alumina gel microspheres, 5-14 micron

TABLE 7

| Anti-Loading Composition - Ceramic Microspheres (12 micron) | | | | | | |
|---|---|---|---|---|---|---|
| | S26 Wt. % (uncured) | S26 Wt. % (cured) | S27 Wt. % (uncured) | S27 Wt. % (cured) | S28 Wt. % (uncured) | S28 Wt. % (cured) |
| Metal Stearate[1] (Zinc Stearate) | 88.89 | 88.3 | 88.02 | 86.5 | 87.17 | 84.8 |
| Defoamer | 0.25 | 0.5 | 0.25 | 0.5 | 0.24 | 0.5 |
| Ceramic Microspheres[3] (5-12 micron) | 0.99 | 2.0 | 1.96 | 4.0 | 2.91 | 5.8 |
| Polymeric Binder[2] | 9.87 | 9.2 | 9.77 | 9.0 | 9.68 | 8.8 |

Figure 6:
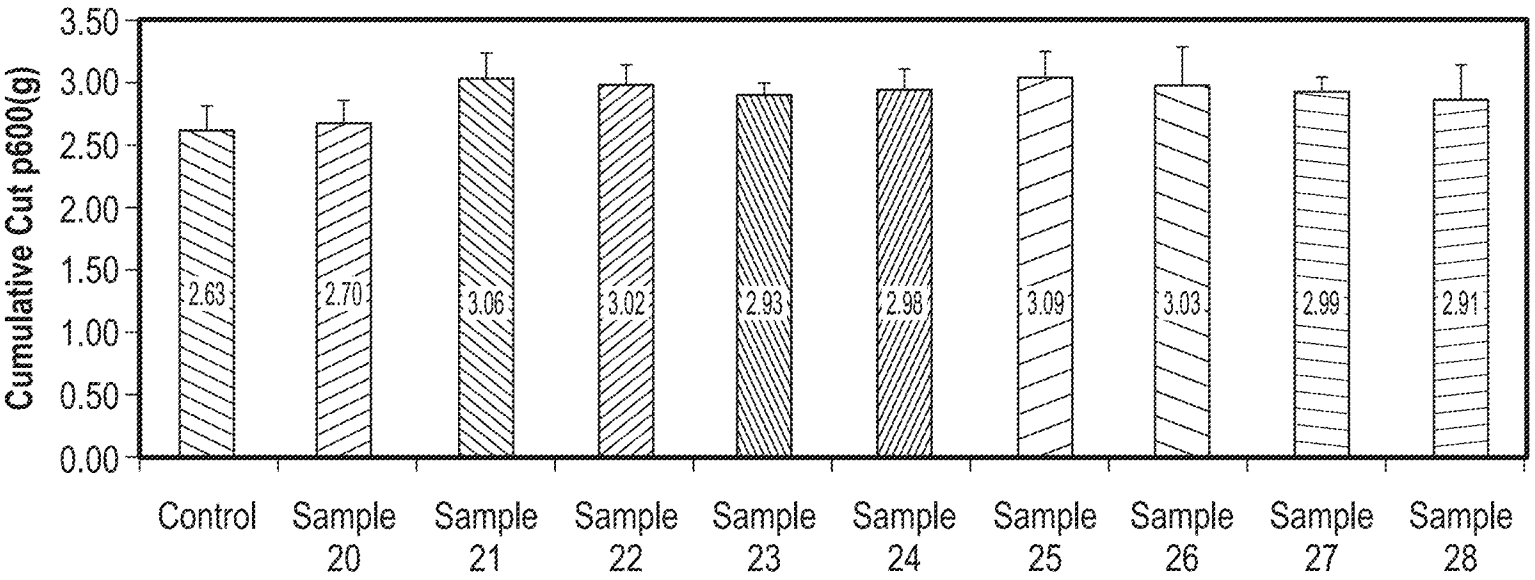
FIG. 6 is a graph showing cumulative material removal performance of a conventional coated abrasive article compared to coated abrasive article embodiments that include an anti-loading composition having a ceramic microsphere performance component.

[1]Zinc stearate dispersion (48 wt. % total solids; 44 wt. % zinc stearate )
[2]Acrylic latex emulsion (45 wt. % solids)
[3]Zeeospheres, silica alumina gel microspheres, 5-12 micron The anti-loading compositions S20 to S28 were applied as a supersize layer onto the size coat of coated abrasive discs. The anti-loading compositions were cured to form sample abrasive discs (Sample 20 to Sample 28). The sample abrasive discs were then subjected to abrasive testing compared to control abrasive discs. The only difference between the sample discs and the control discs was the presence of the performance component in the anti-loading composition comprising the supersize layer of the sample discs. In other words, the control discs were coated with a conventional zinc stearate composition as a supersize layer that did not contain performance component. The samples were prepared by coating a supersize layer with a 2-roll coater onto a flat stock coated abrasive over the size layer and dried. The resulting coated abrasive articles were then converted to hook and loop backed 6" discs. The discs were tested using a robotic controlled dual action (DA) sander on acrylic panels for 12 minutes. The amount of material removed from the work piece (Total Cut) was recorded and compared to the performance of the control disc. The testing results are shown in the table below and in FIG. 6.

TABLE 8

| Abrasive Performance Compared to Control | | |
|---|---|---|
| | Total Cut (g) | % of Control |
| Control | 2.63 | 100 |
| Sample 20 - (1 wt. %, 150 micron) | 2.70 | 103 |
| Sample 21 - (2 wt. %, 150 micron) | 3.06 | 116 |
| Sample 22 - (3 wt. %, 150 micron) | 3.02 | 115 |

TABLE 8-continued

| Abrasive Performance Compared to Control | | |
|---|---|---|
| | Total Cut (g) | % of Control |
| Sample 23 - (1 wt. %, 14 micron) | 2.93 | 111 |
| Sample 24 - (2 wt. %, 14 micron) | 2.98 | 113 |
| Sample 25 - (3 wt. %, 14 micron) | 3.09 | 117 |
| Sample 26 - (1 wt. %, 12 micron) | 3.03 | 115 |
| Sample 27 - (2 wt. %, 12 micron) | 2.99 | 114 |
| Sample 28 - (3 wt. %, 12 micron) | 2.91 | 111 |

Surprisingly and beneficially, all the sample discs achieved greater performance than the control.

Example 4: Anti-Loading Composition Preparation—Polymeric Microspheres

Anti-loading compositions (uncured) ("S29" to "S36") were prepared by thoroughly mixing together: a metal stearate (zinc stearate dispersion), polymeric microspheres (aliphatic polyurethane microspheres), a polymeric binder (acrylic polymer emulsion), and a defoamer. The resultant uncured anti-loading compositions were then ready to be applied as a supersize coat to coated abrasive articles. Sample uncured and cured anti-loading compositions are shown in the table below.

TABLE 9

| Anti-Loading Composition - Polymeric Microspheres | | | | | | |
|---|---|---|---|---|---|---|
| | 3% Soft Sphere Wt. % (uncured) | 3% Soft Sphere Wt. % (cured) | 5% Soft Sphere Wt. % (uncured) | 5% Soft Sphere Wt. % (cured) | 10% Soft Sphere Wt. % (uncured) | 10% Soft Sphere Wt. % (cured) |
| Metal Stearate[1] (Zinc Stearate) | 87.24 | 85.68 | 85.58 | 82.41 | 81.69 | 75.23 |
| Defoamer | 0.24 | 0.5 | 0.23 | 0.47 | 0.23 | 0.43 |
| Soft Polymer Microspheres[3] (5-20 micron) | 2.9 | 5.95 | 4.75 | 9.54 | 9.08 | 17.43 |
| Polymeric Binder[2] | 9.6 | 7.86 | 9.42 | 7.56 | 8.99 | 6.90 |

Figure 7:
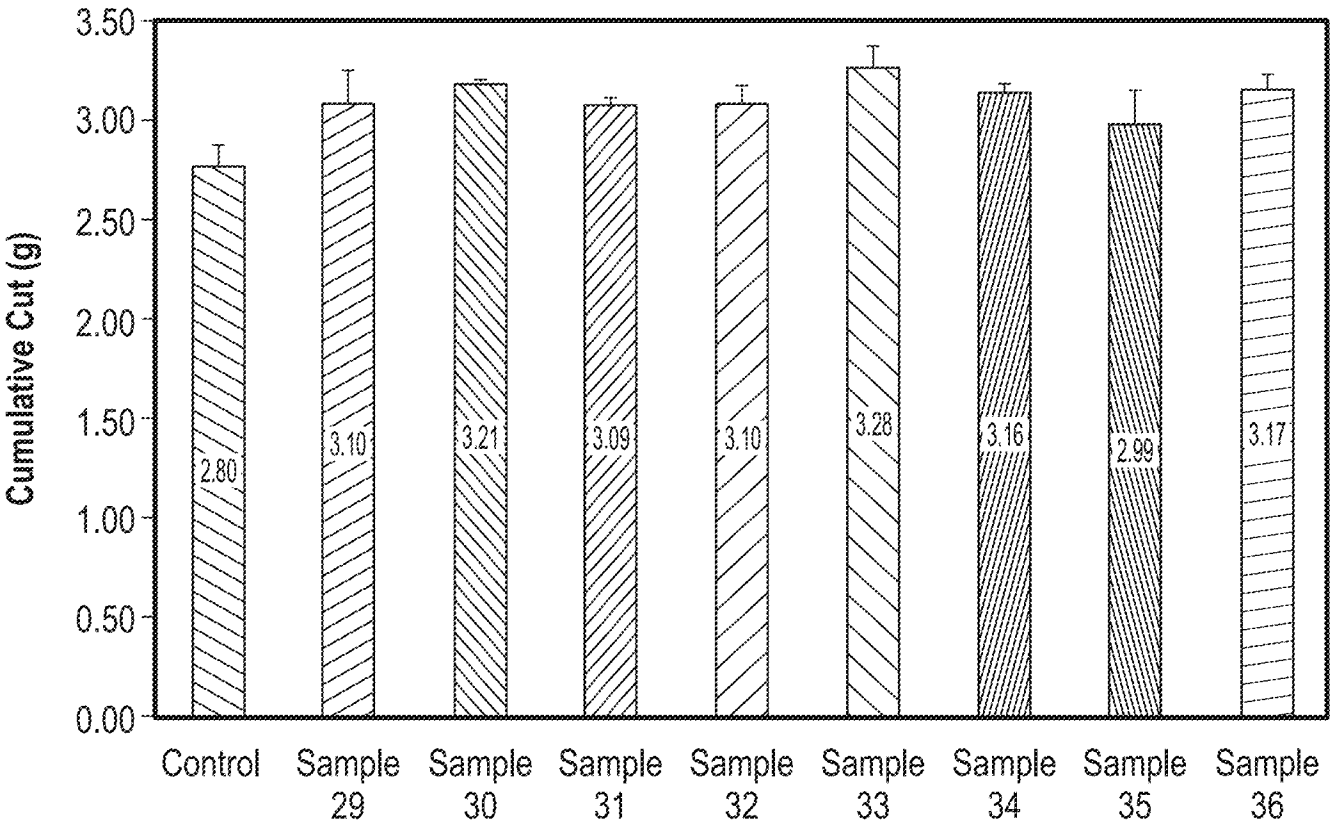
FIG. 7 is a graph showing cumulative material removal performance of a conventional coated abrasive article compared to coated abrasive article embodiments that include an anti-loading composition having a polymeric microsphere performance component.

[1]Zinc stearate dispersion (48 wt. % total solids; 44 wt. % zinc stearate)
[2]Acrylic latex emulsion (45 wt. % solids)
[3]MicroTouch ™, aliphatic polyurethane microspheres, 5-20 micron The anti-loading compositions S29 to S36 were applied as a supersize layer onto the size coat of coated abrasive discs. The anti-loading compositions were cured to produce samples, S29 to S36. S29, S31, and S34 include 5 micron polymeric microspheres; S32 and S35 include 10 micron polymeric microspheres; and S30, S33, and S36 include 20 micron microspheres. The sample abrasive discs were then subjected to abrasive testing compared to control abrasive discs. The only difference between the sample discs and the control discs was the presence of the performance component in the anti-loading composition comprising the supersize layer of the sample discs. In other words, the control discs were coated with a conventional zinc stearate composition as a supersize layer that did not contain performance component. The samples were prepared by coating a supersize layer with a 2-roll coater onto a flat stock coated abrasive over the size layer and dried. The resulting coated abrasive articles were then converted to hook and loop backed 6" discs. The discs were tested using a robotic controlled dual action (DA) sander on acrylic panels for 12 minutes. The amount of material removed from the work piece (Total Cut) was recorded and compared to the performance of the control disc. The testing results are shown in the table below and in FIG. 7.

TABLE 10

| Abrasive Performance Compared to Control | | |
|---|---|---|
| | Total Cut (g) | % of Control |
| Control | 2.80 | 100 |
| Sample 29 - (5 wt. %, 5 micron) | 3.10 | 111 |
| Sample 30 - (20 wt. %, 20 micron) | 3.21 | 115 |
| Sample 31 - (5 wt. %, 5 micron) | 3.09 | 110 |
| Sample 32 - (10 wt. %, 10 micron) | 3.10 | 111 |
| Sample 33 - (20 wt. %, 20 micron) | 3.28 | 117 |
| Sample 34 - (5 wt. %, 5 micron) | 3.16 | 113 |
| Sample 35 - (10 wt. %, 10 micron) | 2.99 | 107 |
| Sample 36 - (20 wt. %, 20 micron) | 3.17 | 113 |

Surprisingly and beneficially, all the sample discs achieved greater performance than the control.

Example 5: Anti-Loading Composition Preparation—Ceramic Microspheres

Anti-loading compositions (uncured) were prepared by thoroughly mixing together: a metal stearate, ceramic microspheres (silica alumina gel microspheres of 2%, 5%, and 10%), a polymeric binder (acrylic polymer emulsion), and a defoamer. The resultant uncured anti-loading compositions were then ready to be applied as a supersize coat to coated abrasive articles.

Figure 8:
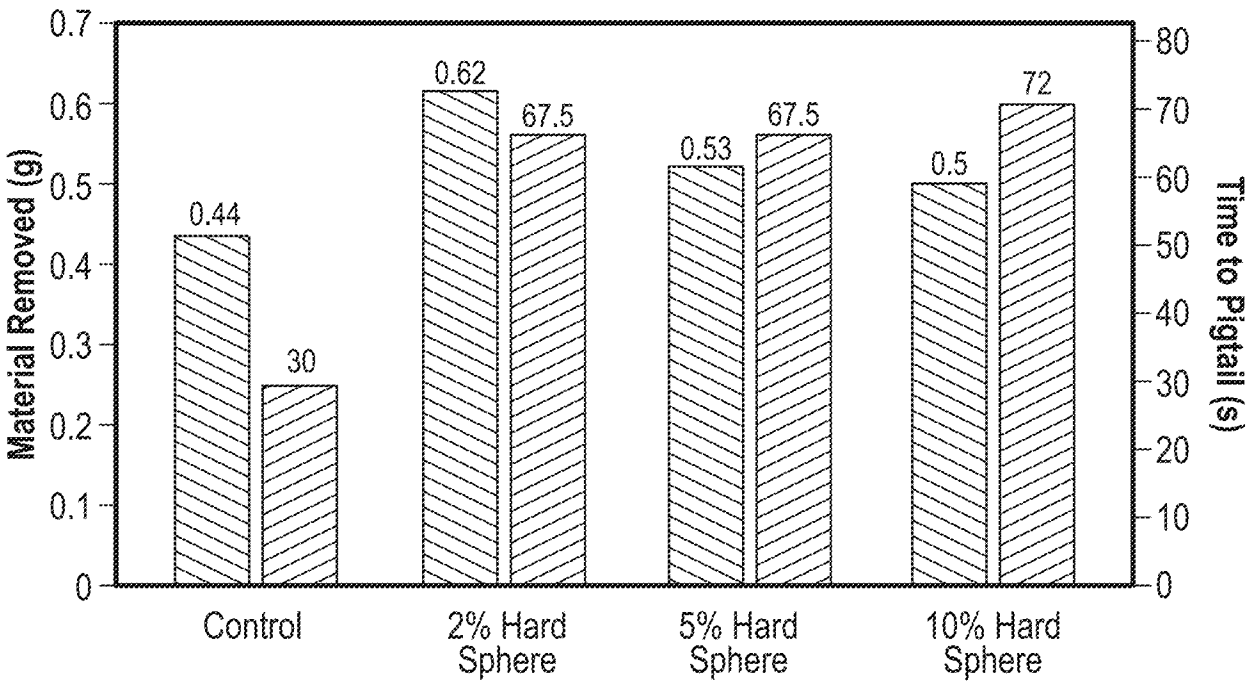
FIG. 8 is a graph showing material removal and time to pigtail performance of a conventional coated abrasive article compared to coated abrasive article embodiments that include an anti-loading composition having a ceramic microsphere performance component.

The anti-loading compositions containing 2%, 5%, and 10% ceramic microspheres were applied as a supersize layer onto the size coat of coated abrasive discs. In some embodiments, the anti-loading compositions containing 2%, 5%, and 10% ceramic microspheres may correlate to one or more of anti-loading compositions S20-S28. The anti-loading compositions were cured to form sample abrasive discs. The sample abrasive discs were then subjected to abrasive testing compared to control abrasive discs. The only difference between the sample discs and the control discs was the presence of the performance component in the anti-loading composition comprising the supersize layer of the sample discs. In other words, the control discs were coated with a conventional zinc stearate composition as a supersize layer that did not contain performance component. The samples were prepared by coating a supersize layer with a 2-roll coater onto a flat stock coated abrasive over the size layer and dried. The resulting coated abrasive articles were then converted to hook and loop backed 6" discs. The discs were tested using a robotic controlled dual action (DA) sander on acrylic panels until "pigtailling" was visible. The amount of material removed from the work piece and the time to pigtail were recorded and compared to the performance of the control disc. The testing results are shown in FIG. 8.

Surprisingly and beneficially, all the sample discs achieved greater performance (more material removed and longer time to pigtail) than the control.

Example 6: Anti-Loading Composition Preparation—Polymeric Microspheres

Anti-loading compositions (uncured) were prepared by thoroughly mixing together: a metal stearate, ceramic microspheres (aliphatic polyurethane microspheres of 3%, 5%, and 10%), a polymeric binder (acrylic polymer emulsion), and a defoamer. The resultant uncured anti-loading compositions were then ready to be applied as a supersize coat to coated abrasive articles.

Figure 9:
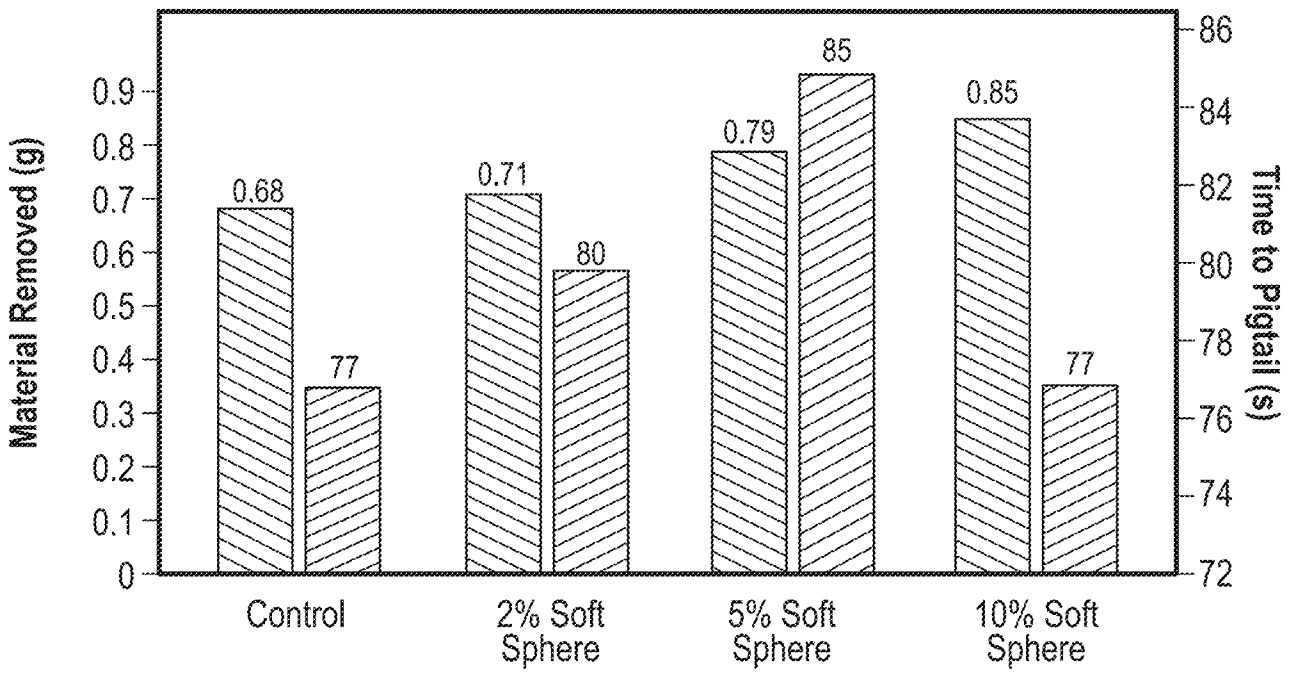
FIG. 9 is a graph showing material removal and time to pigtail performance of a conventional coated abrasive article compared to coated abrasive article embodiments that include an anti-loading composition having a polymeric microsphere performance component.

The anti-loading compositions containing 3%, 5%, and 10% polymeric microspheres were applied as a supersize layer onto the size coat of coated abrasive discs. In some embodiments, the anti-loading compositions containing 3%, 5%, and 10% polymeric microspheres may correlate to one or more of anti-loading compositions S29-S36. The anti-loading compositions were cured to form sample abrasive discs. The sample abrasive discs were then subjected to abrasive testing compared to control abrasive discs. The only difference between the sample discs and the control discs was the presence of the performance component in the anti-loading composition comprising the supersize layer of the sample discs. In other words, the control discs were coated with a conventional zinc stearate composition as a supersize layer that did not contain performance component. The samples were prepared by coating a supersize layer with a 2-roll coater onto a flat stock coated abrasive over the size layer and dried. The resulting coated abrasive articles were then converted to hook and loop backed 6" discs. The discs were tested using a robotic controlled dual action (DA) sander on acrylic panels until "pigtailling" was visible. The amount of material removed from the work piece and the time to pigtail were recorded and compared to the performance of the control disc. The testing results are shown in FIG. 9.

Surprisingly and beneficially, all the sample discs achieved greater performance (more material removed and longer time to pigtail) than the control.

Example 7: Surface Transparency—Protein

An anti-loading composition (uncured) ("S37") was prepared by thoroughly mixing together: a metal stearate (zinc stearate dispersion, 48 wt. % total solids, 44% wt. % zinc stearate), a protein (whey protein), a polymeric binder (acrylic polymer emulsion), and a defoamer. S37 included 5 wt. % of whey protein. The resultant uncured anti-loading composition was then ready to be applied as a supersize coat to coated abrasive articles. The anti-loading composition is shown in the table below.

TABLE 11

Anti-Loading Composition - Whey Protein

| | S37 Wt. % (uncured) | S37 Wt. % (cured) |
|---|---|---|
| Metal Stearate[1] (Zinc Stearate) | 85.51 | 81.7 |
| Defoamer | 0.24 | 0.5 |
| Whey Protein | 4.76 | 9.4 |
| Polymeric Binder[2] | 9.49 | 8.5 |

[1]Zinc stearate dispersion (48 wt. % total solids; 44 wt. % zinc stearate)
[2]Acrylic latex emulsion (45 wt. % solids)

The anti-loading composition S37 was applied as a supersize layer onto the size coat of coated abrasive discs. The anti-loading composition was cured to form sample abrasive discs (Sample 37). The sample abrasive discs were compared to control abrasive discs. The only difference between the sample discs and the control discs was the presence of the performance component in the anti-loading composition comprising the supersize layer of the sample discs. In other words, the control discs were coated with a conventional zinc stearate composition as a supersize layer that did not contain performance components.

Figure 10:
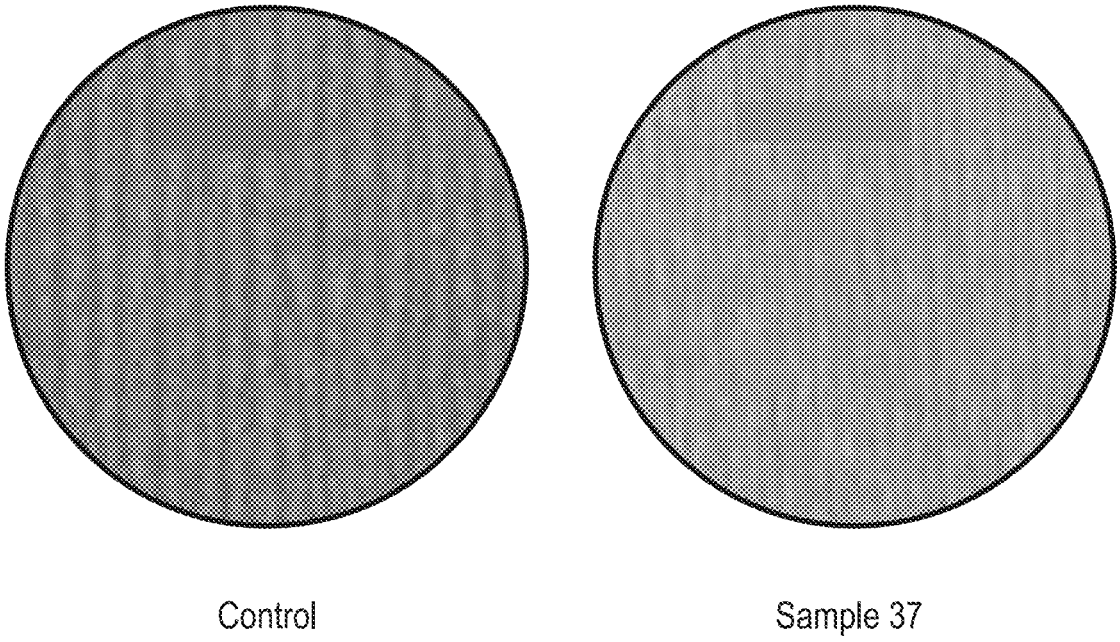
FIG. 10 is an illustration showing a conventional coated abrasive article having an anti-loading composition having opaque streaks compared to a coated abrasive article embodiment having a transparent anti-loading composition that includes a protein performance component.

The sample abrasive disc was visually compared to the control disc. Surprisingly and beneficially, the supersize coat of Sample 37 was substantially transparent. Notably, the supersize coat was free of opaque streaking defects (commonly known as "chicken tracks"). FIG. 10 shows the appearance of the control sheet (on left) and the sample disc (on right).

Example 8: Wax in Anti-Loading Composition

An anti-loading composition was prepared by thoroughly mixing together: a metal stearate (zinc stearate dispersion, 48 wt. % total solids, 44% wt. % zinc stearate), a protein (whey protein), a polymeric binder (acrylic polymer emulsion), and a defoamer. S38 included 20 wt. % of wax. The resultant uncured anti-loading composition was then ready to be applied as a supersize coat to coated abrasive articles. The anti-loading composition was cured to form sample abrasive discs (Sample 38). The sample abrasive discs were compared to control abrasive discs. The only difference between the sample discs and the control discs was the presence of the performance component in the anti-loading composition comprising the supersize layer of the sample discs. In other words, the control discs were coated with a conventional zinc stearate composition as a supersize layer that did not contain performance components.

Surprisingly and beneficially, the sample discs achieved greater performance (greater cumulative cut) than the control. The results are shown in the table below.

TABLE 12

Anti-Loading Composition - Wax

| | Total Cut (g) | % of Control |
|---|---|---|
| Control | 1.86 | 100 |
| Sample 38 - (20 wt. %, Wax) | 2.05 | 110 |

Still other versions may include one or more of the following embodiments:

Embodiment 1

An abrasive article, comprising: a backing material; an abrasive layer disposed on the backing material, wherein the abrasive layer comprises a plurality of abrasive particles disposed at least partially on or in a make coat binder composition; a size coat disposed over the abrasive layer; and a supersize coat disposed over the size coat, wherein the supersize coat comprises a mixture of a metal stearate or a hydrate form thereof, at least one performance component, and a polymeric binder composition.

Embodiment 2

The coated abrasive article of embodiment 1, wherein the metal stearate comprises zinc stearate, calcium stearate, lithium stearate, hydrate forms thereof, or a combination thereof.

Embodiment 3

The coated abrasive article of embodiment 2, wherein the performance component comprises a metal sulfide, a fatty acid, a wax, a protein, a microsphere, a plurality of microspheres, or a combination thereof.

Embodiment 4

The coated abrasive article of embodiment 3, wherein the metal sulfide comprises an iron sulfide, a copper sulfide, a copper iron sulfide, or a combination thereof.

Embodiment 5

The coated abrasive article of embodiment 4, wherein the metal sulfide comprises not less than 0.5 wt. % to not greater than 35 wt. % of the mixture.

Embodiment 6

The coated abrasive article of embodiment 3, wherein the wax comprises a natural wax, a synthetic wax, or a combination thereof.

Embodiment 7

The coated abrasive article of embodiment 3, wherein the wax comprises a fatty acid ester or plurality of fatty acid esters, a fatty alcohol or plurality of fatty alcohols, an acid or plurality of acids, a hydrocarbon or plurality of hydrocarbons, or a combination thereof.

Embodiment 8

The coated abrasive article of embodiment 7, wherein the wax comprises not less than 0.5 wt. % to not greater than 25 wt. % of the mixture.

Embodiment 9

The coated abrasive article of embodiment 3, wherein the protein comprises a whey protein.

Embodiment 10

The coated abrasive article of embodiment 9, wherein the supersize coat is substantially transparent, and wherein the supersize coat is substantially free of opaque streaking defects.

Embodiment 11

The coated abrasive article of embodiment 10, wherein the whey protein comprises not less than 0.1 wt. % to not greater than 30 wt. % of the mixture.

Embodiment 12

The coated abrasive article of embodiment 3, wherein the microspheres comprises ceramic microspheres, polymeric microspheres, glass microspheres, or a combination thereof.

Embodiment 13

The coated abrasive article of embodiment 12, wherein the ceramic microspheres comprise a silica gel, an alumina gel, a silica alumina gel, or a combination thereof.

Embodiment 14

The coated abrasive article of embodiment 13, wherein the ceramic microspheres comprise an amorphous material, a crystalline material, a solid material, a porous material, or a combination thereof.

Embodiment 15

The coated abrasive article of embodiment 14, wherein the ceramic microspheres comprise an amorphous, porous silica alumina gel.

Embodiment 16

The coated abrasive article of embodiment 12, wherein the polymeric microspheres comprise a polyurethane, a polystyrene, a polyethylene, a rubber, a poly(methyl methacrylate) (PMMA), a glycidyl methacrylate, an epoxy, or a combination thereof.

Embodiment 17

The coated abrasive article of embodiment 16, wherein the polymeric microspheres comprise an aliphatic polyurethane.

Embodiment 18

The coated abrasive article of embodiment 13, wherein the microspheres comprises not less than 0.1 wt. % to not greater than 20 wt. % of the mixture.

Embodiment 19

The coated abrasive article of embodiment 3, wherein the mixture comprises: 50-95 wt. % of the metal stearate; 1-35 wt. % of the performance component; and 1-25 wt. % of the polymeric binder composition.

Embodiment 20

The coated abrasive article of embodiment 3, wherein the performance component comprises a metal sulfide and a plurality of microspheres.

Embodiment 21

The coated abrasive article of embodiment 20, wherein the mixture composition comprises: 50-95 wt. % of the metal stearate; 1-35 wt. % of the metal sulfide; 0.1 to 20 wt. % of the plurality of microspheres; and 1-25 wt. % of the polymeric binder composition.

Embodiment 22

The coated abrasive article of embodiment 21, wherein the microspheres comprises ceramic microspheres, polymeric microspheres, or a combination thereof.

Embodiment 23

The coated abrasive article of embodiment 22, wherein the ceramic microspheres comprise an amorphous, porous silica alumina gel.

Embodiment 24

The coated abrasive article of embodiment 22, wherein the polymeric microspheres comprise an aliphatic polyurethane.

Embodiment 25

The coated abrasive article of embodiment 20, wherein the performance component further comprises a wax.

Embodiment 26

The coated abrasive article of embodiment 25, wherein the mixture comprises: 50-95 wt. % of the metal stearate; 1-35 wt. % of the metal sulfide; 0.1 to 20 wt. % of the plurality of microspheres; 0.5 wt. % to 25 wt. % of the wax; and 1-25 wt. % of the polymeric binder composition.

Embodiment 27

A method of making a coated abrasive article comprising: mixing together a metal stearate, at least one performance component, and a polymeric binder composition to form an anti-loading composition; and disposing the anti-loading composition on an abrasive layer of the coated abrasive article.

Embodiment 28

The method of embodiment 27, wherein the anti-loading composition comprises: 50-95 wt. % of the metal stearate; 1-35 wt. % of the performance component; and 1-25 wt. % of the polymeric binder composition.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity can not be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

What is claimed is:

1. An abrasive article, comprising:

a backing material;

an abrasive layer disposed on the backing material, wherein the abrasive layer comprises a plurality of abrasive particles disposed at least partially on or in a make coat binder composition;

a size coat disposed over the abrasive layer; and a supersize coat disposed over the size coat, wherein the supersize coat comprises a mixture of a metal stearate or a hydrate form thereof, at least one performance component, and a polymeric binder composition, wherein the metal stearate comprises zinc stearate, calcium lithium stearate, hydrate forms thereof, or a combination thereof, wherein the performance component comprises a wax, wherein the wax comprises a fatty acid ester or plurality of fatty acid esters, a fatty alcohol or plurality of fatty alcohols, an acid or plurality of acids, a hydrocarbon or plurality of hydrocarbons, or a combination thereof.

2. An abrasive article, comprising:

a backing material;

an abrasive layer disposed on the backing material, wherein the abrasive layer comprises a plurality of abrasive particles disposed at least partially on or in a make coat binder composition;

a size coat disposed over the abrasive layer; and a supersize coat disposed over the size coat, wherein the supersize coat comprises a mixture of a metal stearate or a hydrate form thereof, at least one performance component, and a polymeric binder composition, wherein the metal stearate comprises zinc stearate, calcium stearate, lithium stearate, hydrate forms thereof, or a combination thereof, wherein the performance component comprises a metal sulfide, wherein the metal sulfide comprises an iron sulfide, a copper sulfide, a copper iron sulfide wherein the metal sulfide comprises not less than 0.5 wt. % to not greater than 35 wt. % of the mixture.

3. The coated abrasive article of claim 1, wherein the wax comprises a natural wax, a synthetic wax, or a combination thereof.

4. The coated abrasive article of claim 1, wherein the wax comprises not less than 0.5 wt. % to not greater than 25 wt. % of the mixture.

5. An abrasive article, comprising:

a backing material;

an abrasive layer disposed on the backing material wherein the abrasive layer comprises a plurality of abrasive particles disposed at least partially on or in a make coat binder composition;

a size coat disposed over the abrasive layer; and a supersize coat disposed over the size coat, wherein the supersize coat comprises a mixture of a metal stearate or a hydrate form thereof, at least one performance component, and a polymeric binder composition, wherein the metal stearate comprises zinc stearate, calcium lithium stearate, hydrate forms thereof, or a combination thereof, wherein the performance component comprises a protein, wherein the protein comprises a whey protein.

6. The coated abrasive article of claim 5, wherein the supersize coat is substantially transparent, and wherein the supersize coat is substantially free of opaque streaking defects.

7. The coated abrasive article of claim 6, wherein the whey protein comprises not less than 0.1 wt. % to not greater than 30 wt. % of the mixture.

8. An abrasive article, comprising:

a backing material;

an abrasive layer disposed on the backing material, wherein the abrasive layer comprises a plurality of abrasive particles disposed at least partially on or in a make coat binder composition;

a size coat disposed over the abrasive layer; and a supersize coat disposed over the size coat, wherein the supersize coat comprises a mixture of a metal stearate or a hydrate form thereof, at least one performance component, and a polymeric binder composition, wherein the metal stearate comprises zinc stearate, calcium stearate, lithium stearate, hydrate forms thereof, or a combination thereof, wherein the performance component comprises a metal sulfide, a fatty acid, a wax, a protein, a microsphere, a plurality of microspheres, or a combination thereof, wherein the microspheres comprise ceramic microspheres, wherein the ceramic microspheres comprise a silica gel, an alumina gel, a silica alumina gel, or a combination thereof.

9. The coated abrasive article of claim 8, wherein the ceramic microspheres comprise an amorphous material, a crystalline material, a solid material, a porous material, or a combination thereof.

10. The coated abrasive article of claim 9, wherein the ceramic microspheres comprise an amorphous, porous silica alumina gel.

11. An abrasive article, comprising:

a backing material;

an abrasive layer disposed on the backing material, wherein the abrasive layer comprises a plurality of abrasive particles disposed at least partially on or in a mate coat binder composition, a size coat disposed over the abrasive layer; and a supersize coat disposed over the size coat, wherein the supersize coat comprises a mixture of a metal stearate or a hydrate form thereof, at least one performance component, and a polymeric binder composition, wherein the metal stearate comprises zinc stearate, calcium stearate, lithium stearate, hydrate forms thereof, or a combination thereof, wherein the performance component comprises a plurality of microspheres, wherein the microspheres comprise polymeric microspheres, wherein the polymeric microspheres comprise a polyurethane, a polystyrene, a polyethylene, a rubber, a poly (methyl methacrylate) (PMMA), a glycidyl methacrylate, an epoxy, or a combination thereof.

12. The coated abrasive article of claim 11, wherein the polymeric microspheres comprise an aliphatic polyurethane.

13. An abrasive article, comprising:

a backing material;

an abrasive layer disposed on backing material, wherein the abrasive layer comprises a plurality of abrasive particles disposed at least partially on or in a make coat binder composition;

a size coat disposed over the abrasive layer; and a supersize coat disposed over the size coat, wherein the supersize coat comprises a mixture of a metal stearate or a hydrate form thereof, at least one performance component, and a polymeric binder composition, wherein the metal stearate comprises zinc stearate, calcium stearate, lithium stearate, hydrate forms thereof, or a combination thereof, wherein the performance component comprises a metal sulfide, a fatty acid, a wax, a protein, a microsphere, a plurality of microspheres, or a combination thereof, wherein the mixture comprises:

50-95 wt. % of the metal stearate;

0.1 to 20 wt. % of the plurality of microspheres;

0.5 wt. % to 25 wt. % of a wax; and 1-25 wt. % of the polymeric binder composition.

* * * * *